US005343801A

United States Patent [19]

Schiel

[11] Patent Number: 5,343,801

[45] Date of Patent: Sep. 6, 1994

[54] MULTI-ROLL CALENDER WITH ADJUSTABLE LINEAR FORCE

[75] Inventor: Christian Schiel, Heidenheim, Fed. Rep. of Germany

[73] Assignee: J.M. Voith GmbH, Fed. Rep. of Germany

[21] Appl. No.: 53,044

[22] Filed: Apr. 23, 1993

Related U.S. Application Data

[62] Division of Ser. No. 747,620, Aug. 20, 1991, Pat. No. 5,226,357.

[30] Foreign Application Priority Data

Aug. 24, 1990 [DE] Fed. Rep. of Germany ..... 4026773

[51] Int. Cl.[5] ..... B30B 3/04; D21G 1/02

[52] U.S. Cl. ..... 100/47; 100/162 B; 100/163 A

[58] Field of Search ..... 100/43, 47, 161, 162 R, 100/162 B, 163 R, 163 A, 170

[56] References Cited

U.S. PATENT DOCUMENTS

| | | | |
|---|---|---|---|
| 2,971,457 | 2/1961 | Hold | 100/170 X |
| 3,180,251 | 4/1965 | Tidbury | 100/163 R |
| 4,389,932 | 6/1983 | Pav | 100/170 X |
| 4,472,958 | 9/1984 | Biondetti | 100/47 X |
| 4,485,734 | 12/1984 | Klemmer et al. | 100/47 X |
| 4,597,326 | 7/1986 | Kultaranta | 100/47 X |
| 4,721,039 | 1/1988 | Lehmann | 100/47 |
| 4,903,517 | 2/1990 | Van Haag et al. | 100/47 X |
| 4,936,207 | 6/1990 | Niskanen et al. | 100/47 |
| 5,226,357 | 7/1993 | Schiel | 100/47 |

FOREIGN PATENT DOCUMENTS

| | | | |
|---|---|---|---|
| 3735438 | 5/1989 | Fed. Rep. of Germany | 100/47 |

OTHER PUBLICATIONS

"Umgestaltung eines Zweiwalzenglättwerks Typ H in ein Vierwalzenglättwerk Typ H bei einer Papiermaschine"; Wald; Fachhochshule Rheinland-Pfalz; Aug. 31, 1990; pp. 88-106.

*Primary Examiner*—Stephen F. Gerrity
*Attorney, Agent, or Firm*—Ostrolenk, Faber, Gerb & Soffen

[57] ABSTRACT

A multi-roll calender for treating a web material, of the type which develops a linear force, has at least two rolls stacked one above the other in a press plane. A lower roll is constituted as a sag-compensation roll. The other rolls in the calender stack are all equidistant relative to the sag-compensation roll, i.e., they are supported the same distance away from the two supports of the rolls. One of the outermost rolls (either the top or the bottom roll) is fixed in a stand while all the other rolls are movably mounted. The moveable rolls can be acted upon by support forces acting in the plane of the stack. The support forces and the internal pressure of the sag-compensation roll are adjustable via a control device, e.g., a computer, so that even when the rolls sag, the linear force distribution of the rolls is identical over their width.

5 Claims, 2 Drawing Sheets

A
+f
-f
2
3
4
5
$b_3$
$b_4$
$b_5$
$a_3$
$a_4$
$a_5$
7

MULTI-ROLL CALENDER WITH ADJUSTABLE LINEAR FORCE

This is a division of application Ser. No. 07/747,620, filed Aug. 20, 1991 (U.S. Pat. No. 5,226,357).

BACKGROUND OF THE INVENTION

The present invention refers to a calender having at least three rolls and at least two nips for developing an adjustable linear force needed for treating a web material.

Between two successive nips, a web may follow along the surface of the roll lying between the two nips or it may be conducted over guide rolls traversing a larger loop as it travels from one nip to the next. The rolls can have working surfaces of steel, chilled cast iron, paper, polymer with the same or alternate pairing of materials. It is, in general, customary and also advisable to arrange or stack the rolls substantially vertically above one another. In this manner, a desired increase in linear force from nip to nip is obtained, assisted by gravity derived from the weight of the rolls themselves. If the linear force were to be increased too abruptly, longitudinal streaking or folding would result, impairing the quality of the web material, particularly, for instance, if the same is paper.

Before the introduction of sag-compensation rolls, the lowermost roll of a vertically stacked calender had to be made to have a very large diameter and to be cambered to counteract its expected sag. However, if the cambering was not effected accurately, an unequal distribution of the linear force occurred between the center and the edges.

This difficulty was solved with sag-compensated rolls, in which, by adjusting the hydraulic pressure in the resting zone on the jacket, the sag of the lower rolls (and thus of all upper rolls) is counteracted. The problem of incorrect cambering was thus obviated, as rolls could be ground cylindrically to have a uniform shape.

The aforementioned arrangement is satisfactory where constant smoothness for the end product is desired. Also, by controlling the number of upper rolls, the desired gloss level could be adjusted stepwise. Changes in gloss which resulted, for instance, from variations in the entrance of the web during operation could be counteracted only by changing the degree of moisture of the paper, resulting in a higher energy consumption cost.

The art then turned to installing one or more top rolls equipped with sag-correction means. This made it possible to increase the linear force in the nips differently than that established due to the weight of the rolls themselves. The disadvantage of this method is that either large differences in linear force in the stack of rolls are obtained when only a few sag-correction rolls are used or, if a large number of sag-correction rolls are used, higher operational expenses and a more complicated control technique must be tolerated.

Infinitely variable calenders having a large range of variation of the linear forces are also known. These calenders, however, are designed as a double-roll arrangement with only one nip, or several of such calenders are used.

Calenders for wide webs, and particularly those for paper webs, follow (both for smaller and larger linear forces) a pair of expensive sag-compensation rolls which press against each other. Such configurations increase the amount of space required, increase the cost of the overall plant and increase the energy consumption required by each sag-compensation roll. This is also true, in particular, of multi-roll calenders in which two sag-compensation rolls are integrated in order to obtain a very limited adjustability of their linear force.

SUMMARY OF THE INVENTION

Accordingly, it is an object of the present invention to provide a new multi-roll calender system capable of producing an adjustable linear pressure and having a relatively large control range of the linear forces in the calender nips.

It is also an object of the present invention to provide the aforementioned calender system so that it is obtained with relatively simple means that takes up comparatively little space and which is operable and capable of being constructed at a minimum cost.

The foregoing and other objects are achieved based on the discovery that with equidistant supporting of the roll tube of the low sag-compensation roll with the upper rolls, uniform width-wise distribution of the linear force is made possible with upwardly or downwardly bent rolls when all rolls are provided with the same lines of bend. Such a feature is not present in any known multi-roll calender. The invention is made possible by equidistantly supporting all rolls, including the sag-compensation roll, and by setting the width of the web to be approximately equal the pressure chambers of the sag-compensation roll. By "equidistantly supporting" the rolls is meant that the distances of the two supports of each roll around which the roll jackets or roll bodies rotate are all equal to each other.

In principle, it is necessary to act on each roll—with the exception of the (lowermost or uppermost) roll which is firmly supported on the stand—with supporting forces necessary to obtain the same sag for all rolls. If one assumes a given linear force distribution in one nip, for instance in the top one, then, in accordance with the rules of elastomechanics, the sag of the upper roll and the sags of all rolls in the stack can be calculated therefrom. In the same way, all supporting forces as well as the inner pressure of the sag-compensation roll installed as lower roll can be ascertained by taking into account the known weight forces as well as the inherent stiffnesses of all rolls.

The corresponding supporting forces and internal pressures are interlinked by a, per se, known complex system of equations that reside in the present invention in a control computer. The advantage of the system is that it provides space-saving in a multi-roll calender which is essentially obtained with only a single (comparatively expensive) sag-compensation roll and yet assures a very large linear-force control range.

Other features and advantages of the present invention will become apparent from the following description of the invention which refers to the accompanying drawings.

DETAILED DESCRIPTION OF THE DRAWINGS

Figure 1:
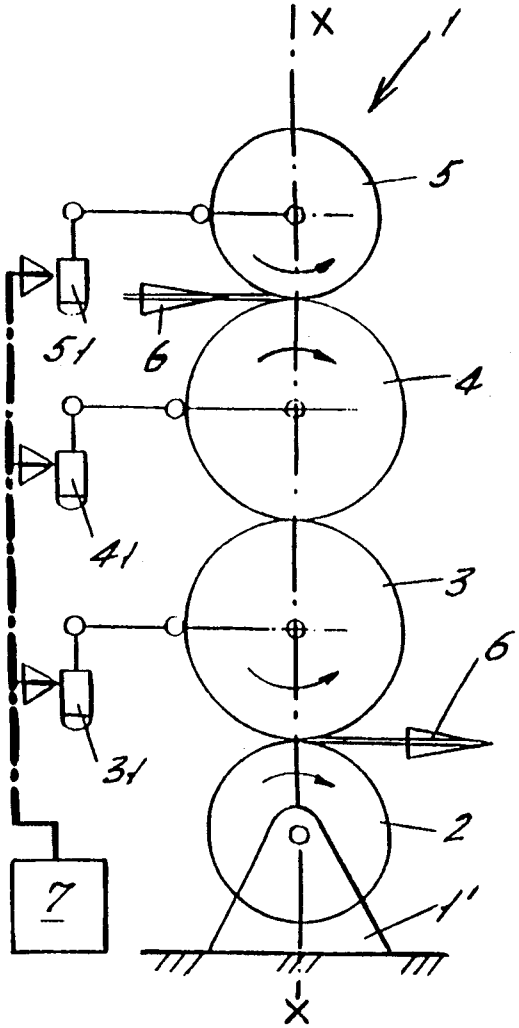
FIG. 1 shows a multi-roll calender with a fixed sag-compensation roll as the lowermost roll.

FIG. 1 is a basic diagram of a four-stage multi-roll calender 1 having a sag-compensation roll 2 fixed in a supporting bracket 1' and, above it, three additional rolls 3, 4 and 5, all arranged in a common press plane X—X. Between these four, vertically stacked rolls 2–5, a web of material 6 to be treated is threaded so that it follows a path starting at the nip between the upper roll 5 and the adjacent roll 4, travelling to the nip between the rolls 3 and 4 and exiting from the multi-roll calender 1 at the nip between the lower fixed sag-compensation roll 2 and its adjacent roll 3. The rolls 3, 4 and 5, stacked in the press plane (stack plane) X—X and situated above the sag-compensation roll 2, are all movably mounted in such a manner that forces can be introduced at their support points. This enables the rolls 3, 4 and 5 to bend in a desired and consistently reproducible manner.

This force introduction step is effected by means of force controlling elements 31, 41, 51, which are arranged on both sides of the rolls 3, 4, 5 and in each case are functionally connected with a support point. With the force elements 31, 41, 51, the support points can be acted on, as desired, either in the same direction or oppositely to the force exerted by the weight of the rolls, based on control signals outputted by a control computer 7.

The control computer 7 is programmed in accordance with a complex system of formulas of the multi-roll calender 1 which formulas associate the values of the weight forces, the linear forces resulting therefrom, and the sag-free linear forces. The control computer 7 also determines the internal pressure of the sag-compensation roll 2 which is necessary in each case.

Figure 2:
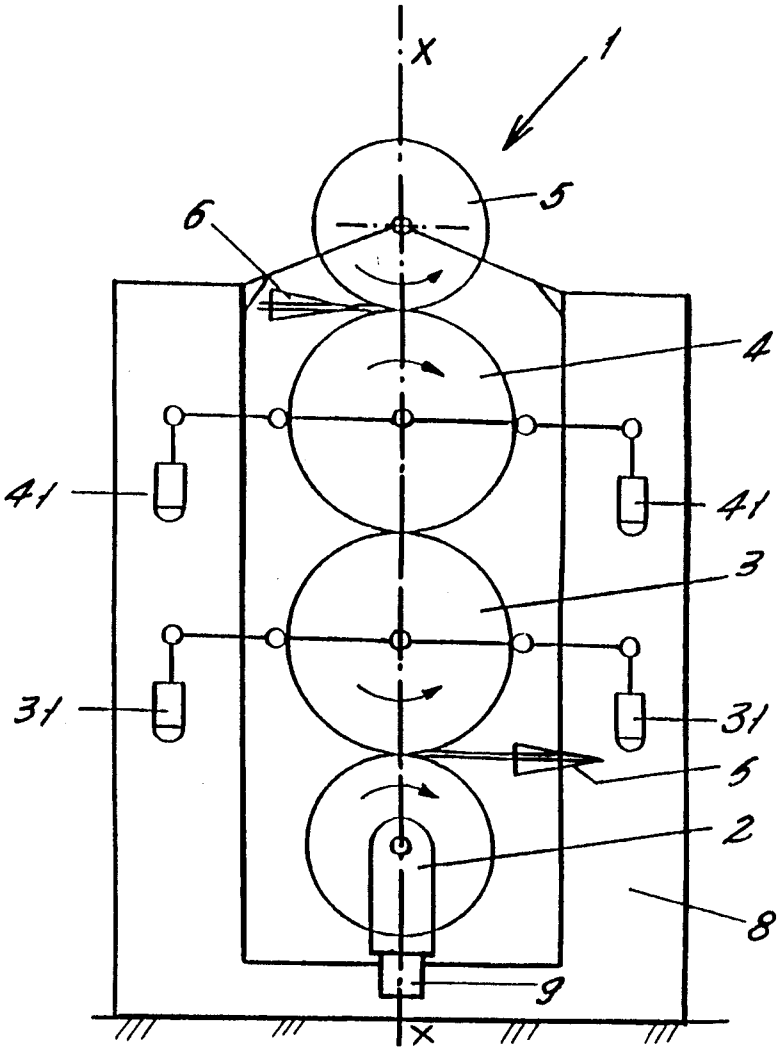
FIG. 2 shows a multi-roll calender with a fixed upper roll.

FIG. 2 illustrates a basic four-stage multi-roll calender 1 in which the uppermost roll 5 is fixedly mounted in a stand 8. The other rolls 3, 4, including the sag-compensation roll 2, are movably mounted for vertical displacement. Displacement of the two center rolls 3, 4 is effected by force elements 31, 41, which elements are themselves mounted in a column frame 8. The sag-compensation roll 2 is moveable by means of a lift element 9 which is arranged between the columns of the column frame 8. In the multi-roll calender 1 shown in FIG. 2, the two middle rolls 3, 4 are mounted in brackets (not shown) which are supported in each case on both sides in the column frame 8. They are acted upon via these brackets by means of the force elements 31, 41 arranged on both sides of the column frame 8, in accordance with requested adjustment forces or such forces as are computed in the control computer 7.

Figure 3:
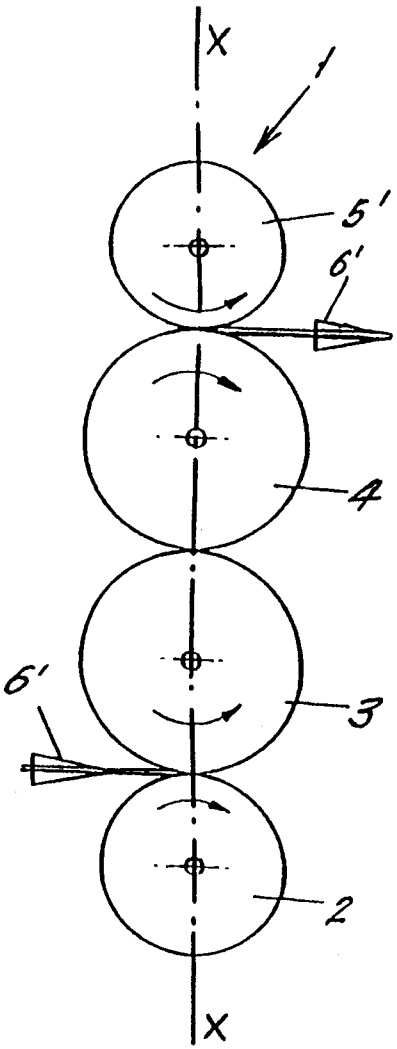
FIG. 3 shows a multi-roll calender with a positively cambered upper roll and a web of material extending from the bottom to the top.

FIG. 3 shows, by means of another basic diagram, a four-step multi-roll calender 1. In accordance with FIG. 3, which can be effected either with a fixed sag-compensation roll 2 (in accordance with FIG. 1) or with a fixed top roll 5 (in accordance with FIG. 2), the top roll 5' is positively cambered. The three upper rolls 3, 4, 5' of the multi-roll calender 1 can also be acted upon via force elements with the necessary adjustment forces. The basic concept of this construction is that—starting from the camber of the top roll—the stiffness of the lower rolls decreases in downward direction and that—contrary to the path of the web shown on basis of FIGS. 1 and 2—the web of material 6' follows an upward direction through the multi-roll calender 1.

Figures 4A, 4B, 4C:
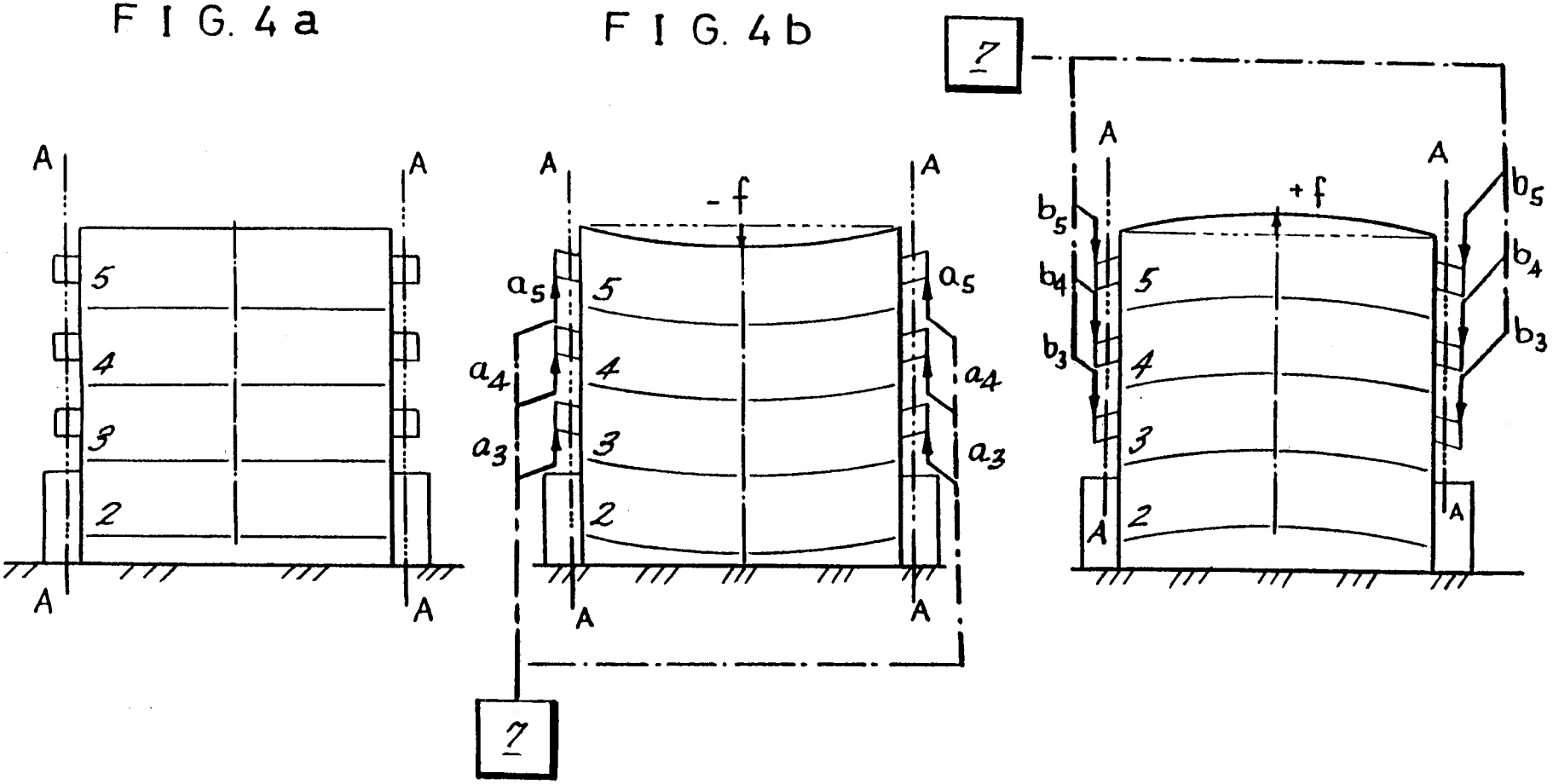
FIGS. 4*a*, 4*b* and 4*c* illustrate a multi-roll calender in accordance with a front view of FIGS. 1, 2 and 3 showing, respectively, the operating conditions: "no roll sag" (FIG. 4*a*); "with roll relief" (FIG. 4*b*); and "with additional loading of the rolls" (FIG. 4*c*).

FIGS. 4*a*–4*c* illustrate different operating conditions of the multi-roll calender 1 shown in FIG. 1, also corresponding, however, to the multi-roll calender 1 of FIGS. 2 and 3.

FIG. 4*a* shows a four-stage multi-roll calender 1 in an ideal state in which the rolls 2, 3, 4 and 5 have neither positive nor negative sags. Viewed transversely relative to the multi-role calender 1 and thus to the web of material, the linear force is constant and uniformly distributed. Relative to FIG. 4*a*, it should be particularly pointed out that the rolls 2, 3, 4 and 5 of the multi-roll calender 1 are supported precisely equidistantly. By this is meant that the distance between the two end supports for each of the rolls around which the roll jackets and the roll bodies turn (measured from the midpoint of the axis of the bearing at one of the end supports to the axial midpoint of the other bearing, i.e., of the other end support) are all equal to one another and that the connecting lines A—A of the supports are precisely parallel to the press plane X—X of the multi-roll calender 1.

FIG. 4*b* shows a four-stage multi-roll calender 1 in which the load on the upper rolls 3, 4, 5 is relieved. This is effected by applying pressure forces $a_3$–$a_5$, as shown, which forces act on the support points in the connecting line A—A (FIG. 4*a*), in a direction opposite to the weight force. The magnitudes of the forces $a_3$–$a_5$ are determined in the control computer 7 and cause a corresponding (convex) roll sag of "−f".

FIG. 4*c* shows a four-stage multi-roll calender 1 in which an additional load is applied on the upper rolls 3, 4, 5. This loading of the rolls is effected by means of pressure forces $b_3$–$b_5$ which act on the support points in the connecting line A—A (FIG. 4*a*) in the same direction as the weight force. These forces are similarly determined in the control computer 7. The pressure forces $b_i$ ($b_3$–$b_5$) produce a concave roll sag "+f".

In accordance with one particular embodiment, the sag-compensation roll 2 can be developed as a profiled roll in which case the jacket and yoke are supported equidistantly with the upper rolls 3, 4, 5 fixed in the stand.

In principle, the rolls which are arranged above the sag-compensation roll 2 have equal stiffnesses, in which case it must be ensured that the upper rolls differ in each case by less than 1.5 $Nmm^2$ with respect to their stiffnesses (stiffness = modulus of elasticity in $N/mm^2$ times moment of inertia in $mm^4$). In accordance with one special embodiment, the stiffness of the rolls increases slightly in the downward direction.

With a configuration as explained and specified above, one obtains a multi-roll calender 1 in which both the support forces and the inner pressure of the sag-compensation roll can be so adjusted that, with due consideration of weight forces and linear forces between the rolls, each roll has precisely the same bending profile relative to its axis.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A multi-roll calender capable of developing an adjustable linear force for treating a web material, comprising:

at least two rolls stacked one above the other in a press plane, the rolls including a top roll and a bottom roll and other rolls;

a roll stand including a pair of roll supports, the bottom roll being constituted as a sag-compensation roll having an internal pressure and the other rolls being mounted relative to the sag-compensation roll equidistantly from the pair of roll supports;

the top roll being fixedly mounted in said stand;

a moveable support including two columns for movably mounting all the other rolls;

means for applying to the other rolls support forces which act in the plane of the stack;

a controller for adjusting the support forces and the internal pressure of the sag-compensation roll, the controller being such that even with sagging of the rolls a distribution of a linear force associated with each roll is uniform over the width of each roll; and wherein all rolls arranged above the sag-compensation roll have substantially equal stiffnesses and wherein the movable support is moveable up and down between the two columns.

2. The multi-roll calender of claim 1, wherein all supports of each of the rolls located between the top roll and the sag-compensation roll are moveable by means of two force generating elements, each of which is disposed in a respective one of the two columns.

3. The multi-roll calender of claim 2, wherein the sag-compensation roll is moveable via lift elements which are arranged between the columns.

4. The multi-roll calender of claim 1, wherein the sag-compensation roll is moveable via lift elements which are arranged between the two columns.

5. A multi-roll calender capable of developing an adjustable linear force for treating a web material, comprising:

at least two rolls stacked one above the other in a press plane, the rolls including a top roll and a bottom roll and other rolls;

a roll stand including a pair of roll supports, the bottom roll being constituted as a sag-compensation roll having an internal pressure and the other rolls being mounted relative to the sag-compensation roll equidistantly from the pair of roll supports;

the top roll being fixedly mounted in said stand;

a moveable support including two columns for movably mounting all the other rolls;

means for applying to the other rolls support forces which act in the plane of the stack;

a controller for adjusting the support forces and the internal pressure of the sag-compensation roll, the controller being such that even with sagging of the rolls a distribution of a linear force associated with each roll is uniform over the width of each roll; and wherein the stiffness of the rolls arranged above the sag-compensation roll increases from the top roll downward and wherein the movable support is moveable up and down between the two columns.

* * * * *